US011434034B2

(12) United States Patent
Lee

(10) Patent No.: US 11,434,034 B2
(45) Date of Patent: Sep. 6, 2022

(54) BAG HOLDER

(71) Applicant: Kyong Mok Lee, Bucheon-si (KR)

(72) Inventor: Kyong Mok Lee, Bucheon-si (KR)

( * ) Notice: Subject to any disclaimer, the term of this patent is extended or adjusted under 35 U.S.C. 154(b) by 0 days.

(21) Appl. No.: 17/299,316

(22) PCT Filed: Dec. 6, 2018

(86) PCT No.: PCT/KR2018/015435
§ 371 (c)(1),
(2) Date: Jun. 3, 2021

(87) PCT Pub. No.: WO2020/116687
PCT Pub. Date: Jun. 11, 2020

(65) Prior Publication Data

US 2022/0055782 A1 Feb. 24, 2022

(51) Int. Cl.
*B65F 1/14* (2006.01)
*B65B 67/12* (2006.01)

(52) U.S. Cl.
CPC ..... *B65B 67/1244* (2013.01); *B65F 1/14* (2013.01); *B65F 1/1415* (2013.01)

(58) Field of Classification Search
CPC ... B65B 7/12; B65B 67/1227; B65B 67/1216; B65B 67/1233; B65B 67/04; B65B 67/1205; B65B 67/1244; B65B 67/1255; B65F 1/14; B65F 1/1415
USPC ..... 248/99, 95, 100, 101
See application file for complete search history.

(56) References Cited

U.S. PATENT DOCUMENTS 396,561 A * 1/1889 Harrison ..... B65F 1/1415 248/99
608,638 A * 8/1898 Becker ..... B65B 67/1227 248/100
2,213,937 A * 9/1940 Tompkins ..... A45F 3/20 248/99
2,340,540 A * 2/1944 Lange ..... A47B 61/003 211/1.3
2,789,781 A * 4/1957 Miller ..... B65B 67/1244 248/100
2,815,186 A * 12/1957 Miller ..... B65B 67/1244 248/99
3,260,488 A * 7/1966 Kliewer ..... B65B 67/1244 248/99
3,653,619 A * 4/1972 Plum ..... B65B 67/1216 248/99
3,724,921 A * 4/1973 Lake ..... B65F 1/1415 312/237
3,861,630 A * 1/1975 Ady ..... B65B 67/125 248/100
3,912,208 A * 10/1975 Grenetier ..... B65B 43/26 248/99

(Continued)

FOREIGN PATENT DOCUMENTS

JP 2007-204233 A 8/2007
JP 2010-013283 A 1/2010

(Continued)

*Primary Examiner* — Nkeisha Smith
(74) *Attorney, Agent, or Firm* — Patent Office of Dr. Chung Park

(57) ABSTRACT

The present disclosure relates to a bag holder, and according to the present disclosure, the bag holder provided is where a movement of opening or closing an inlet portion of a bag can be implemented stably while occupying minimum space.

3 Claims, 8 Drawing Sheets

(56) References Cited

U.S. PATENT DOCUMENTS

| | | | | | |
|---|---|---|---|---|---|
| 4,815,866 | A * | 3/1989 | Martone | B65B 67/1238 | 141/390 |
| 5,167,390 | A * | 12/1992 | Baghdadi | B65B 67/1205 | 248/95 |
| 5,183,227 | A * | 2/1993 | Wilhite | B65B 67/1205 | 248/99 |
| 6,471,267 | B2 * | 10/2002 | Asazuma | A01K 23/005 | 248/99 |
| 6,893,158 | B1 * | 5/2005 | Tipp | B65F 1/06 | 156/270 |
| 9,033,291 | B2 * | 5/2015 | Branham | B65B 67/1205 | 248/99 |
| 2003/0019980 | A1 * | 1/2003 | Licari | B65F 1/1415 | 248/99 |
| 2004/0195467 | A1 * | 10/2004 | Passage | B65F 1/1415 | 248/99 |
| 2013/0334375 | A1 * | 12/2013 | Chiarella | B65B 67/1227 | 248/99 |
| 2021/0188542 | A1 * | 6/2021 | Ayers | B65F 1/1623 | |

FOREIGN PATENT DOCUMENTS

| | | | |
|---|---|---|---|
| KR | 20-1998-0025160 | U | 7/1998 |
| KR | 10-1170254 | B1 | 7/2012 |
| KR | 10-2018-0021600 | A | 3/2018 |

* cited by examiner

[Fig. 1]
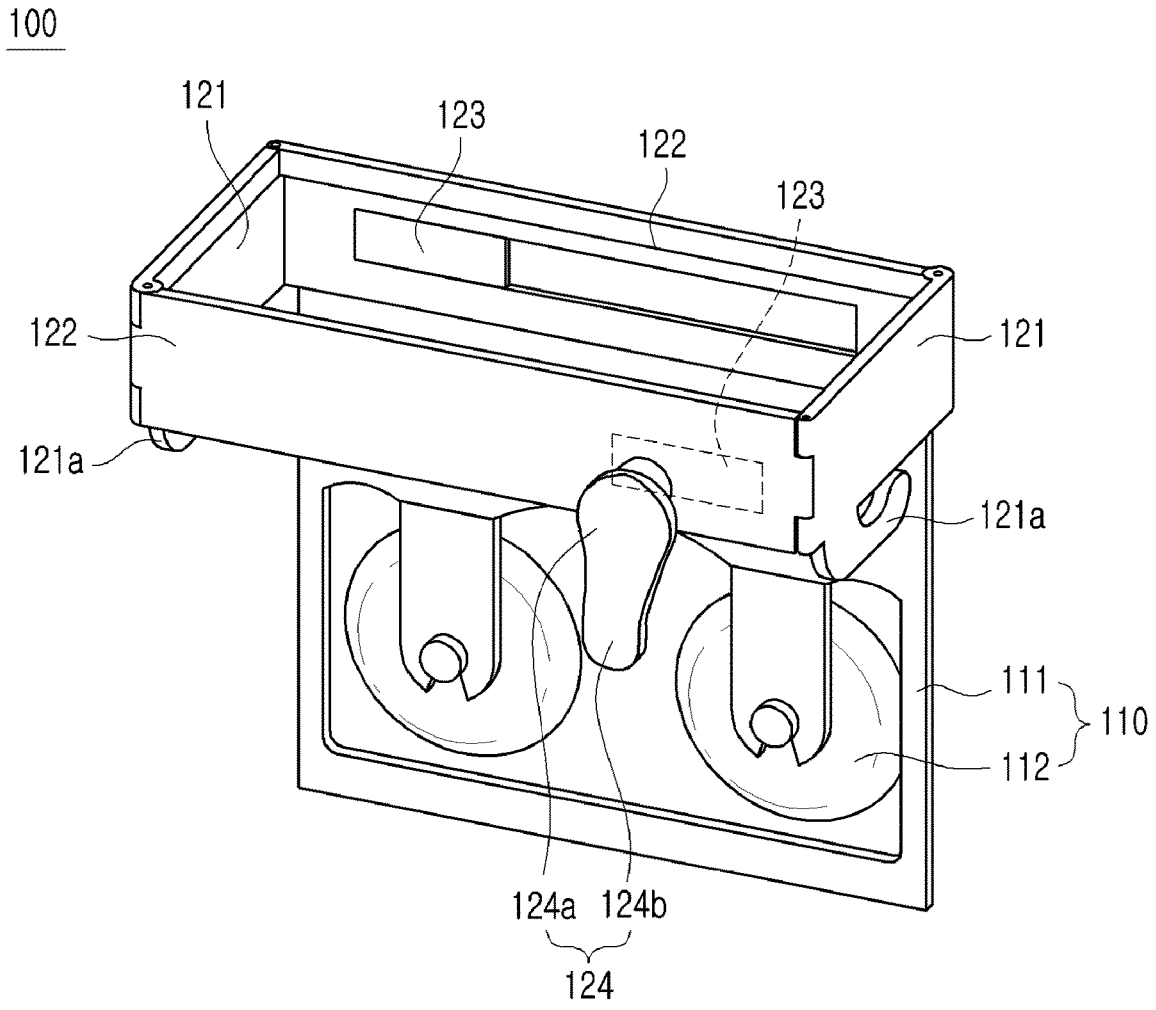

[Fig. 2]
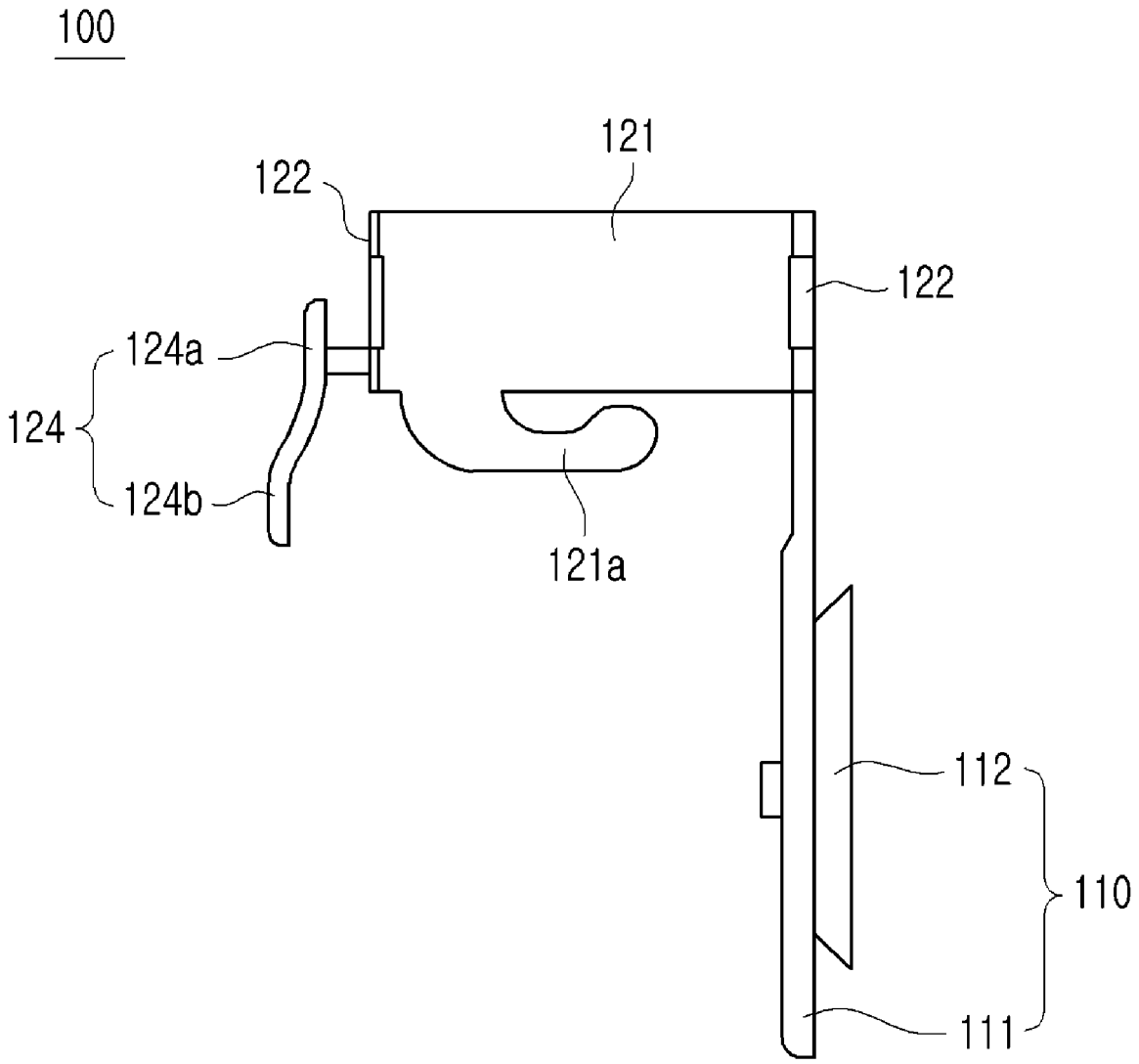

[Fig. 3]
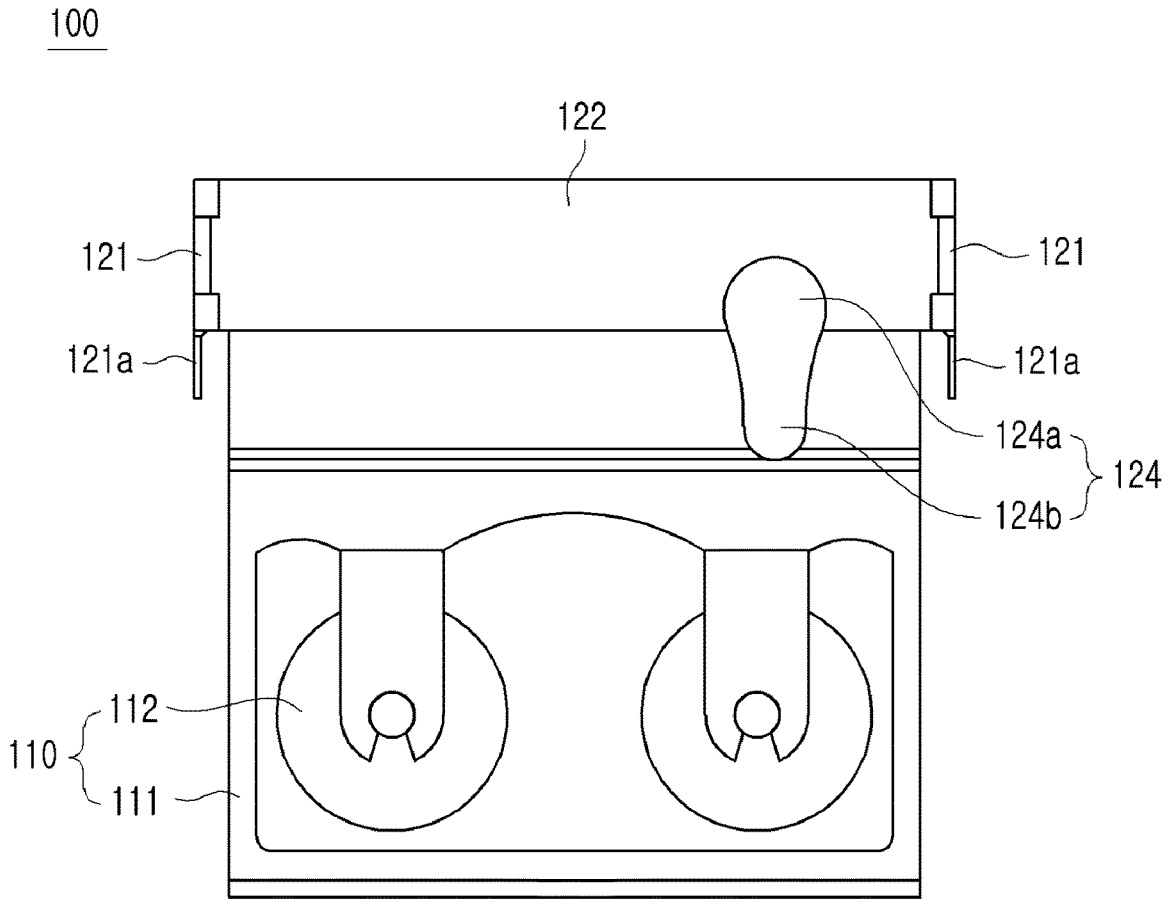

[Fig. 4]
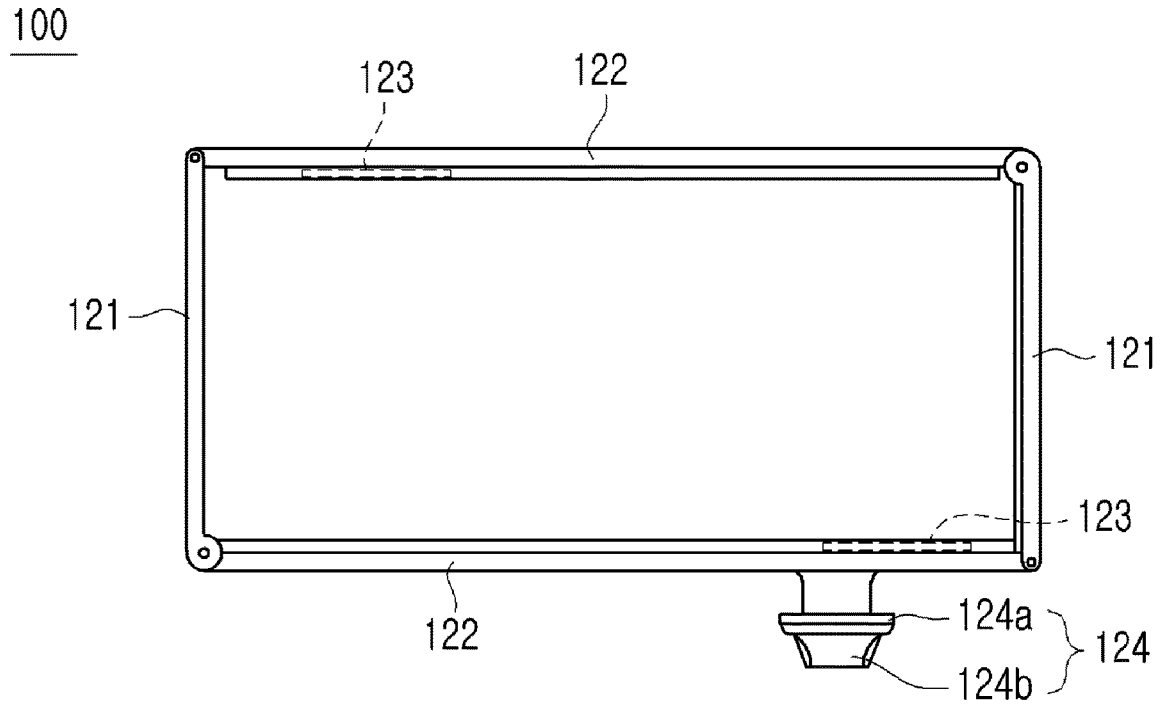

[Fig. 5A]
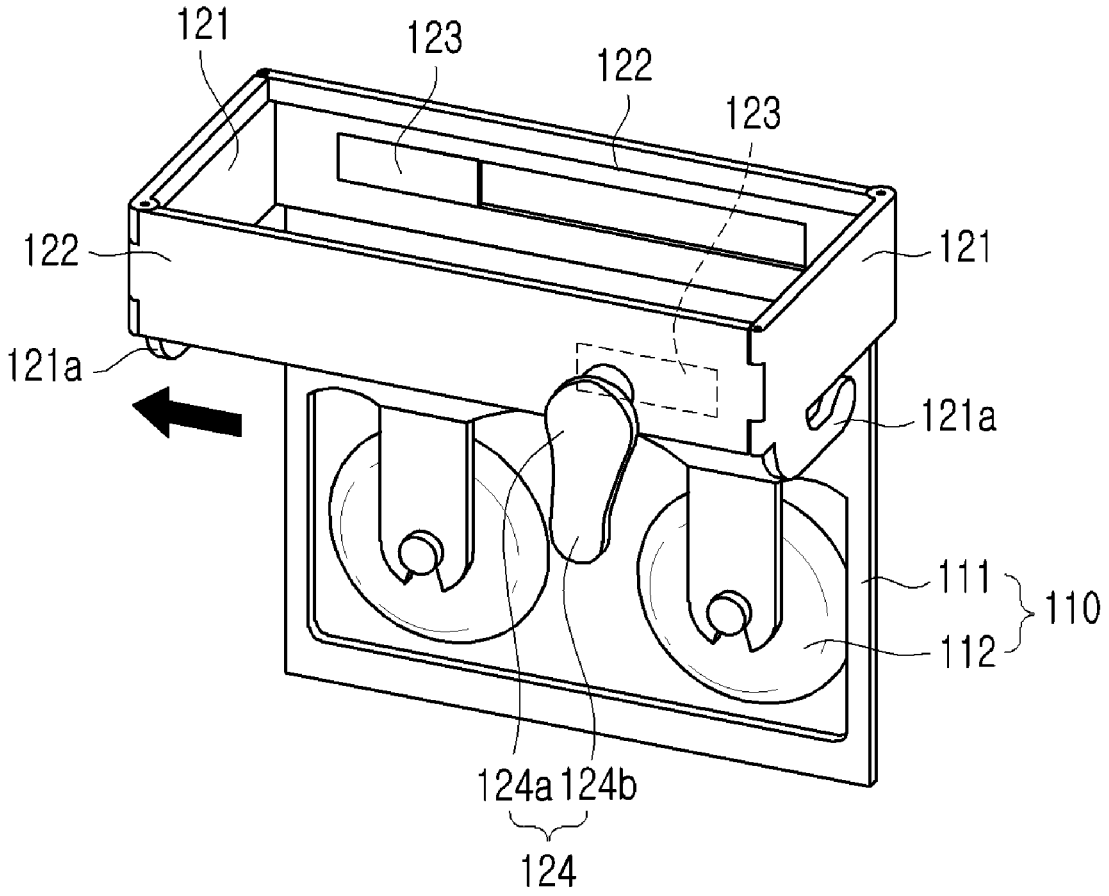

[Fig. 5B]
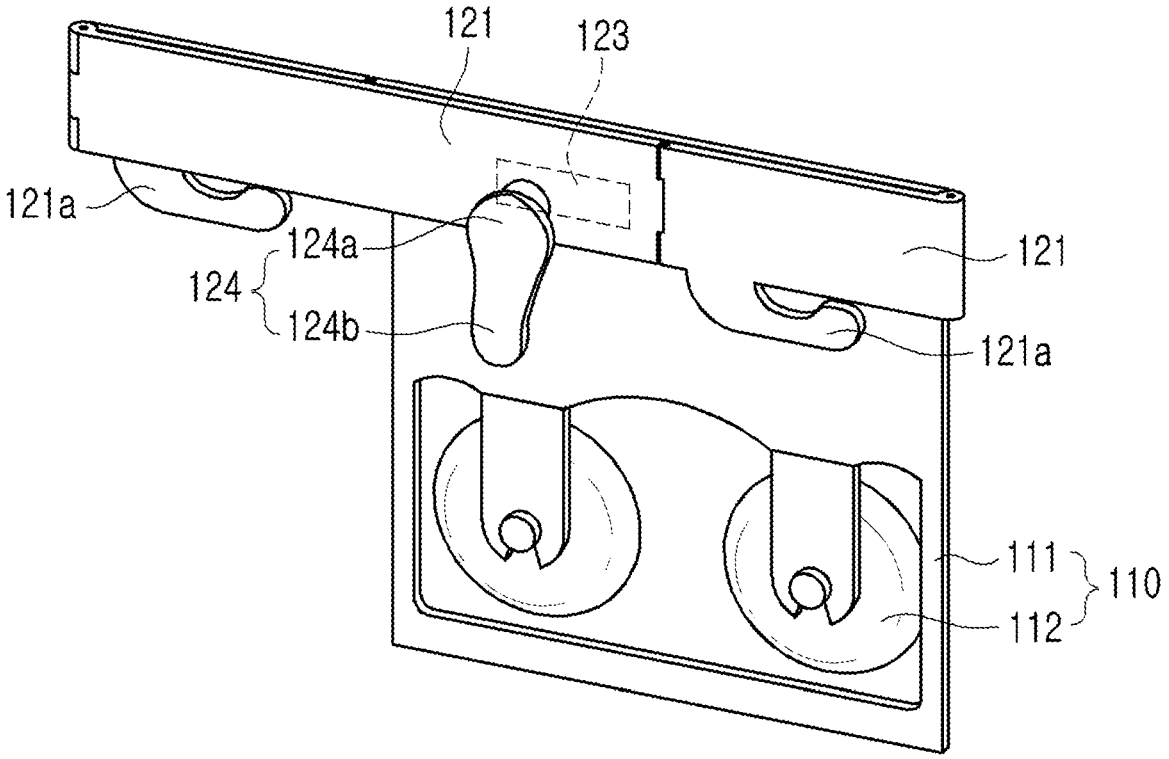

[Fig. 6]
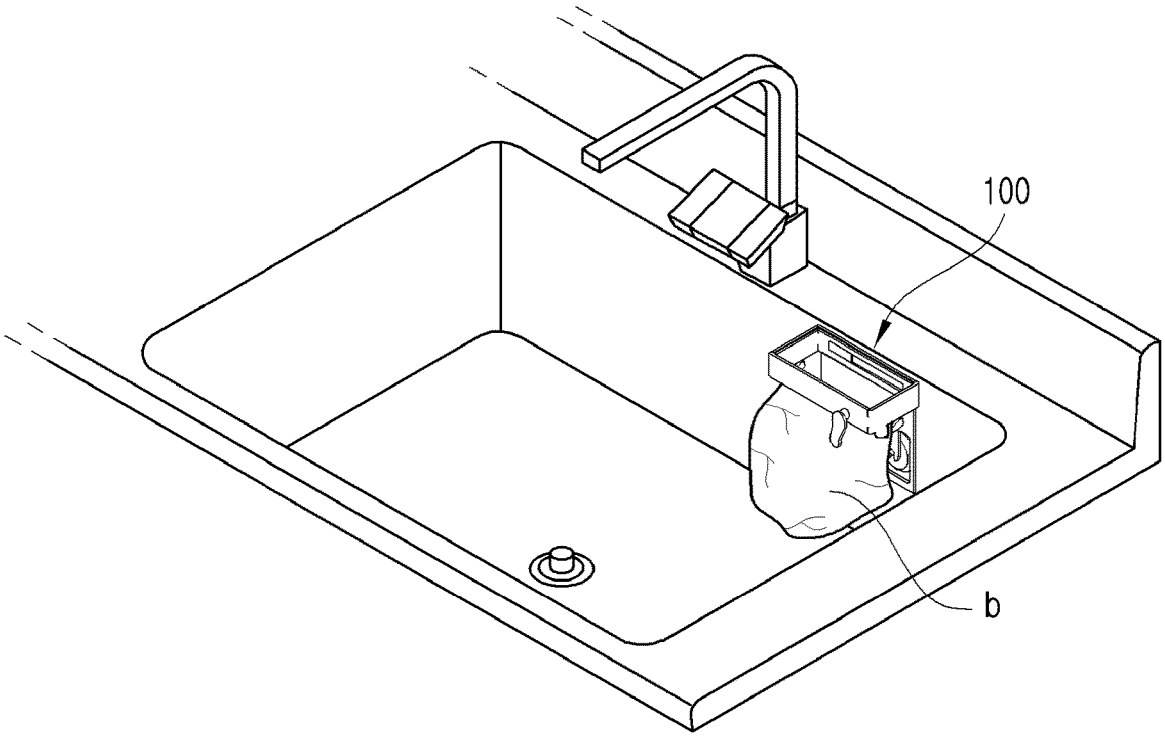

[Fig. 7]
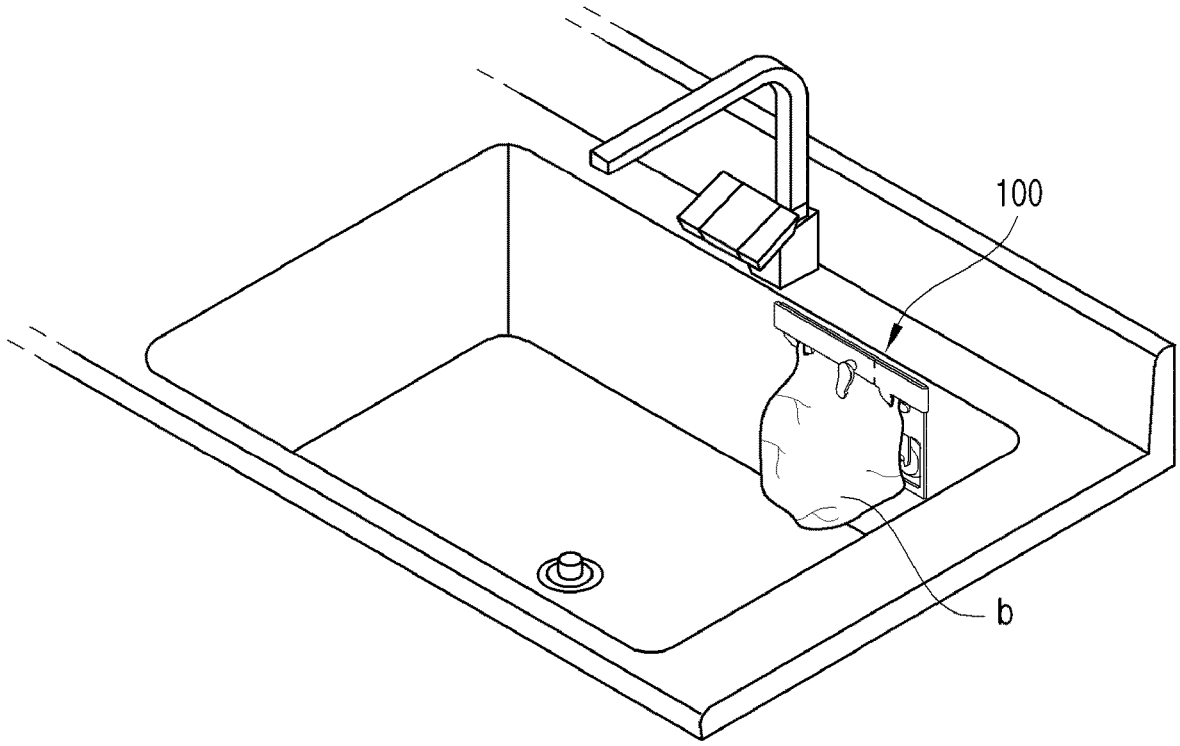

BAG HOLDER

FIELD

The present disclosure relates to a bag holder, and more particularly, to a bag holder which uses a main body part provided in a hinge structure so that a movement of opening or closing an inlet portion of a bag can be stably implemented while occupying minimum space.

BACKGROUND

In restaurants and homes, sinks are installed to provide space for washing dishes. A lot of foreign substances such as food remaining on dishes and the like occur in the process of washing dishes. These foreign substances must be disposed of in a separate plastic bag exclusively provided for food waste, not in a general garbage plastic bag.

These foreign substances occur in the process of washing dishes, so they are wet with water. Therefore, it is very cumbersome to accommodate such foreign substances in a plastic bag during the process of washing dishes or after washing dishes.

In response to the above-mentioned problem, in order to facilitate the inflow of foreign substances into a plastic bag, a bag holder has been proposed that can be attached to one side of a sink while at the same time holding an inlet of the plastic bag.

Korean Laid-open Patent No. 10-2013-0084822 discloses a food garbage clear bag and holder thereof.

A holding member 300 of the Korean Laid-open Patent No. 10-2013-0084822 has a structure that holds an inlet of a bag, and where an upper side is closed with a lid 400, and attached to a sink through an adsorption plate. In a case where this holding member 300 is attached to the sink, since the holding member 300 occupies a large amount of space inside the sink, there is a problem that the space for washing dishes becomes too small.

In response to the above-mentioned problem of the holder in the Korean Laid-open Patent No. 10-2013-0084822, a product that could minimize the space it occupies inside the sink, was recently developed, wherein the structure for holding an inlet of the bag is provided in one pair of elastic material so that when external force is applied, it could widen or shrink, thereby enabling the inner space of the sink to be utilized to the maximum.

However, in this product, there is a hygienic problem that due to the movement occurring when the one pair of elastic material widen or shrink, the water existing on the bag or the structure gets dispersed to the surrounding area of the sink.

SUMMARY

Therefore, a purpose of the present disclosure is to resolve the above-mentioned problems of prior art, that is, to provide a bag holder which uses a main body part provided in a hinge structure so that a movement of opening or closing an inlet portion of a bag can be stably implemented while occupying minimum space.

The above-mentioned purpose may be achieved by a bag holder including an attachment part provided such that it is attachable to an object; and a main body part that is installed on the attachment part, and that holds an inlet portion of a bag, and that is provided in a hinge structure, and that receives external force to be rotated, thereby opening or closing the inlet of the bag.

Further, the main body part may include first frame parts that are provided in one pair, and that form a holding member that holds the inlet portion of the bag, and second frame parts that are provided in one pair, each of which rotatably couples with each of the first frame parts.

Further, the main body part may further include an adhesive part installed on the second frame parts such that the one pair of second frame parts can be adhered to each other.

Further, the main body part may further include a handle part that is installed on either one of the one pair of second frame parts in a protruding form.

Further, the attachment part may further include a base that is installed on either one of the one pair of second frame parts, and an adsorption member that is installed on the base and that is adsorbed to the object.

According to the present disclosure, due to the hinge structure, the form of the main body part can be altered, and thus there is an effect of minimizing the occupying space in the sink.

Further, according to the present disclosure, due to the hinge structure, the movement of opening or closing the inlet portion of the bag can be stably implemented, and thus there is an effect of preventing the water existing on the bag or the structure from being dispersed to the surrounding of the sink.

Further, according to the present disclosure, as a protruding portion formed at an inlet of the bag is interposed in the holding member, the bag holds the first frame parts, and thus there is an effect of utilizing the load capacity of the bag to the maximum.

BRIEF DESCRIPTION OF THE DRAWINGS

FIG. 1 is a perspective view of a bag holder according to an embodiment of the present disclosure;

FIG. 2 is a side view of the bag holder according to an embodiment of the present disclosure;

FIG. 3 is a front view of the bag holder according to an embodiment of the present disclosure;

FIG. 4 is a plane view of the bag holder according to an embodiment of the present disclosure;

FIGS. 5A and 5B are overall illustrations of movements of the bag holder according to an embodiment of the present disclosure;

FIG. 6 illustrates the bag holder according to an embodiment of the present disclosure attached to a sink; and FIG. 7 illustrates movements of the bag holder according to an embodiment of the present disclosure attached to the sink.

DETAILED DESCRIPTION

Hereinbelow, some embodiments of the present disclosure will be described in detail through the exemplary drawings. In adding reference numerals to components of each drawing, it should be noted that even if the components are displayed on different drawings, like reference numerals are used for like components as much as possible.

Further, in describing the embodiments of the present disclosure, if it is determined that a specific description of a related well-known configuration or a function interrupts the understanding of the embodiments of the present disclosure, detailed description thereof will be omitted.

Further, in describing the components of the present disclosure, terms such as a first, a second, A, B, (a), (b) and the like may be used. Such terms are merely used to distinguish those components from other components, and not to limit the nature, sequence or order of the corresponding components.

Hereinbelow, with reference to the attached drawings, a bag holder according to an embodiment of the present disclosure will be described in detail.

FIG. 1 is a perspective view of a bag holder according to an embodiment of the present disclosure, FIG. 2 is a side view of the bag holder according to an embodiment of the present disclosure, FIG. 3 is a front view of the bag holder according to an embodiment of the present disclosure; and FIG. 4 is a plane view of the bag holder according to an embodiment of the present disclosure.

As illustrated in FIGS. 1 to 3, the bag holder according to an embodiment of the present disclosure includes an attachment part 110 and a main body part 120.

The attachment part 110 is provided such that it is attachable to an object, and is installed on the main body part 120 that will be described hereinafter. Such an attachment part 110 includes a base 111 and an adsorption member 112.

Meanwhile, here, the object means a sink, table, wall, or another structure, that provides one side to which the attachment part may be attached.

The base 111 is installed on either one of second frame parts 122 that will be described hereinbelow, more specifically, of those second frame parts, on the second frame part 122 that is disposed to face an object, that is, the wall. The adsorption member 112 that will be described hereinafter is installed on the base 111.

In such a base 111, to facilitate installation of the adsorption member 112, the portion for disposing the adsorption member 112 is open, and on this open portion, there is formed a vertical member having a groove so as to be fitted and coupled to a protruding end formed at a center of the adsorption member.

Meanwhile, the above-mentioned vertical member may be provided in a plural number, in a horizontal or in a vertical direction, respectively. According to such a plurality of vertical members, a plurality of adsorption members 112 may be installed on the base 111. According to the plurality of vertical members and the plurality of adsorption members 112 as those mentioned above, a bag holder according to an embodiment of the present disclosure 110 may be effectively installed on a broad object, that is, on a broad wall.

The adsorption member 112 is installed on one side of the above-mentioned base 111, and is provided to be adsorbed to an adsorption surface of the object. The adsorption member 112 is preferably made of a synthetic resin material, a rubber material, a silicone material, etc. to facilitate attachment and detachment to and from the adsorption surface of the object. By such an adsorption member 112, the main body part 120 that will be described hereinafter may be disposed on the object in an immobilized manner.

The main body part 120 holds an inlet portion of the bag (b), and is provided in a hinge structure, and receives external force to be rotated, thereby opening or closing the inlet of the bag (b). The main body part 120 is installed on the above-mentioned base 111 of the attachment part 110.

Such a main body part 120 includes first frame parts 121, second frame parts 122, adhesive parts 123 and a handle part 124.

The first frame part 121 has a holding member 121*a* at a lower end that may hold the inlet portion of the bag (b). The first frame parts 121 are provided in one pair, each disposed to face each other. Such a first frame part 121 has a hinge structure at its end. These hinge structures are coupled with hinge structures formed at ends of the second frame parts 122 that will be described hereinafter.

The holding member 121*a* is installed at a lower end of the above-mentioned first frame part 121. The holding member 121*a* forms a holding space where the inlet portion of the bag (b) may be interposed.

Such a holding member 121*a* is installed at a center of the first frame part 121 such that any one of four protruding portions formed at the inlet portion of the bag (b) can be interposed. Since a total of two first frame parts 121 are provided, as two protruding portions, each formed at the inlet portion of the bag (b), are interposed in the two holding members 121*a* formed at the centers of the frame parts 121, the frame part 121 can hold the bag (b).

In a prior art product, that is, in the case of a product where the structure for holding the inlet of the bag (b) is made of one pair of elastic material and thus, when external force is applied the elastic material, moves in a widening or shrinking form, when placing the bag (b) to be held, the bag (b) is turned inside out once and put over the structure. When using such a prior art product, there is a problem that the load capacity of the bag (b) cannot be used as much as the bag (b) is turned inside out.

According to the holding member 121*a* of the bag holder 100 according to an embodiment of the present disclosure, as the protruding portion formed at the inlet of the bag (b) is interposed in the holding member 121*a*, the bag (b) is held at the first frame part 121, and thus there is an effect of utilizing the load capacity of the bag (b) to the maximum.

Meanwhile, it is preferable that the holding member 121*a* that is formed on the first frame part 121 forms an interposing groove at a central portion so as to facilitate interposing of the protruding portion formed at the inlet of the bag (b).

The second frame parts 122 are provided in longer lengths than the above-mentioned first frame parts 121. The second frame parts 122 are provided in one pair, and disposed to face each other, and are coupled with the above-mentioned first frame parts 121, respectively. On the above-mentioned one pair of second frame parts 122, adhesive parts 123 that will be described hereinafter are installed to correspond to each other so that they can be adhered to each other when rotated by the hinge structure. On either one of the one pair of first frame parts 121, the above-mentioned base 111 is installed, and on the other one of the one pair of first frame parts 121, a handle part 124 that will be described hereinafter is installed.

The hinge structure is formed to extend from the ends of the first frame part 121 and the second frame part 122, and includes a hinge axis that will be described hereinafter. Each hinge structure formed on the first frame part 121 and the second frame part 122 is formed complementarily so that the first frame part 121 and the vertical frame part can be coupled.

As illustrated in FIGS. 5A and 5B, according to such a hinge structure, in a case where external force is applied to the first frame part 121 or the second frame part 122, as the shape that the one pair of first frame parts 121 and the one pair of second frame parts 122 form changes from a rectangular shape to a rhombus, the one pair of second frame parts 122 are adhered to each other. According to this process, the inlet of the bag (b) that the first frame part 121 was holding changes from an open state to a closed state.

According to the movements of the first frame parts 121 and the second frame parts 122 by the hinge structure, the space that the first frame parts 121 and the second frame parts 122 occupy in the space inside the object, that is, inside the sink is reduced significantly, and thus there is an effect of utilizing the space inside the sink to the maximum, and the first frame parts 121 holding the bag (b) can move at a stable speed and acceleration, and therefore, during the movements of the first frame parts 121 and the second frame parts 122, there is an effect of preventing water on the bag (b) or the first frame parts 121, second frame parts 122, and base from splattering to the surrounding of the object, that is, the surrounding of the sink.

The adhesive part 123 is installed on each of the one pair of second frame parts 122 so that the one pair of second frame parts 122 can be adhered to each other, and more particularly, the adhesive part 123 is installed on each of the second frame parts such that when the first frame parts 122 are rotated, the adhesive parts 123 are disposed to face each other.

Such an adhesive part 123 may be made of a material with magnetic force or a Velcro type material.

However, such an adhesive part 123 is not necessarily limited to a magnetic material or a Velcro type material. It can be made of any material in any form as long as it can make the one pair of second frame parts to adhere to each other.

The handle part 124 is installed on either one of the one pair of first frame parts 121, and more particularly, on the first frame part 121 that faces the first frame part 121 on which the base 111 is installed. The handle part 124 is installed in a form that it protrudes from the first frame part 121. According to such a handle part 124, there is an effect that a user can easily apply external force to the first frame part 121.

Meanwhile, the handle part 124 may include a first part 124*a* and a second part 124*b*. The first part 124*a* is the portion installed on the first frame part 121, and the second part 124*b* is formed to extend from the first part 124*a*, but also to protrude further externally. According to such a shape of the second part 124*b*, the user can have a better grip on the handle part 124.

According to the above-mentioned main body part 120 that includes the first frame parts 121, the second frame parts 122, the adhesive parts 123 and the handle part 124, the main body part 120 can be moved by the hinge structure, and accordingly, there is an effect that the space that the main body part 120 occupies in the object, that is, in the sink can be minimized. Further, according to the main body part 120, due to the hinge structure, the movement of opening or closing the inlet portion of the bag (b) can be stably implemented, and thus there is an effect of preventing the problem of the water on the bag (b) or on the first frame parts 121, the second frame parts 122 and the base 111 being dispersed to the surrounding of the sink.

That is, according to the bag holder according to an embodiment of the present disclosure that includes the attachment part 110 and the main body part 120, there is an effect of stably implementing the movement of opening or closing the inlet portion of the bag (b) while occupying the space to the minimum.

Hereinafter, movements of the bag holder according to an embodiment of the present disclosure will be described in detail with reference to the attached drawings.

FIGS. 5A and 5B are illustrations of movements of the bag holder according to an embodiment of the present disclosure, FIG. 6 illustrates the bag holder according to an embodiment of the present disclosure attached to the sink, and FIG. 7 illustrates movements of the bag holder according to an embodiment of the present disclosure attached to the sink.

As illustrated in FIGS. 5A and 5B to 7, in a state where the shape that the first frame parts 121 and the second frame parts 122 form is a rectangular shape, when the user grabs the handle part 124 and then applies external force to one side, as the hinge structure formed on the first frame parts 121 and the second frame parts 122 moves, the first frame parts are rotated.

As the first frame parts are rotated, the shape that the first frame parts 121 and the second frame parts 122 form changes from the rectangular shape to a rhombus. Here, when the user applies external force continuously using the handle part 124 until the one pair of second frame parts 122 contact each other, the adhesive parts 123 installed on the one pair of second frame parts 122 are adhered to each other.

As a result of this process, by the holding members 121*a* formed on the first frame parts 121, the inlet of the bag (b) held by the first frame parts 121 is closed.

The above-mentioned closing process of the inlet of the bag (b) is proceeded by the hinge structure, and such a hinge structure may provide an adequate and stable movement speed and movement acceleration of the first frame part 121. Therefore, according to the movements due to the hinge structure, the first frame parts 121 move stably, and accordingly, the problem of the water on the bag (b) or the frame parts 121 and the base 111 being dispersed to the surrounding of the sink during the movement process of the first frame parts 121 is effectively prevented.

In the above, just because all components constituting the embodiments of the present disclosure are described as being combined into one or operating in combination, the present disclosure is not necessarily limited to those embodiments. That is, one or more of those components may be selectively combined and operate, as long as it is within the scope of purpose of the present disclosure.

Further, terms such as "include", "constitute" or "have" described above, unless otherwise stated, should be interpreted as meaning that the corresponding component may be present, that is, other components may be further included rather than being excluded. All terms, including technical or scientific terms, unless otherwise defined, have the same meanings as commonly understood by one of ordinary skill in the art to which the present disclosure belongs. Terms generally used, such as terms defined in the dictionary, should be interpreted as being consistent with the meaning of the context of the related technology, and should not be interpreted as an ideal or excessively formal meaning unless explicitly defined in the present disclosure.

And the above description is merely illustrative of the technical idea of the present disclosure, and by those of ordinary skill in the technical field to which the present disclosure pertains, various modifications and variations can be made without departing from the essential characteristics of the present disclosure.

Therefore, the embodiments disclosed in the present disclosure are not intended to limit the technical idea of the present disclosure, but to explain the technical idea, and the scope of the technical idea of the present disclosure is not limited by these embodiments. The scope of protection of the present disclosure should be interpreted by the following claims, and all technical ideas within the scope equivalent thereto should be construed as being included in the scope of the present disclosure.

What is claimed is:

1. A bag holder comprising:

an attachment part provided such that it is attachable to an object; and a main body part that is installed on the attachment part, and that holds an inlet portion of a bag, and that is provided in a hinge structure, and that receives external force to be rotated, thereby opening or closing the inlet of the bag, wherein the main body part comprises one pair of first frame parts formed to face each other, one pair of second frame parts hinged to be rotatably coupled to each end of the first frame parts, and one pair of holding members protruding from each of the first frame parts to face each other and extending in a longitudinal direction of the each of the first frame parts, wherein the attachment part comprises a base that is installed on either one of the one pair of second frame parts, and an adsorption member that is installed on the base and that is adsorbed to the object, wherein the base has a vertical member with a groove so as to be fitted and coupled to a protruding end of the adsorption member.

2. The bag holder according to claim 1, wherein the main body part further comprises an adhesive part installed on the second frame parts such that the one pair of second frame parts can be adhered to each other.

3. The bag holder according to claim 1, wherein the main body part further comprises a handle part that is installed on either one of the one pair of second frame parts in a protruding form.

* * * * *